United States Patent [19]

Ueda

[11] Patent Number: 4,838,019

[45] Date of Patent: Jun. 13, 1989

[54] SPINNING FRAME CONTROL SYSTEM

[75] Inventor: Yutaka Ueda, Nara, Japan

[73] Assignee: Murata Kikai Kabushiki Kaisha, Kyoto, Japan

[21] Appl. No.: 896,393

[22] Filed: Aug. 13, 1986

[30] Foreign Application Priority Data

Aug. 19, 1985 [JP] Japan ..... 60-182626

[51] Int. Cl.[4] ..... D01H 9/18; D01H 13/26; D01H 13/32; B65H 67/06

[52] U.S. Cl. ..... 57/264; 57/265; 57/276; 57/281; 242/35.5 A; 242/35.6 R

[58] Field of Search ..... 57/264, 265, 266, 274, 57/276, 281, 90; 242/35.5 R, 35.5 A, 35.6 R, 36

[56] References Cited

U.S. PATENT DOCUMENTS 3,263,499 8/1966 Gith et al. ..... 242/35.6 R X
4,425,754 1/1984 Lane ..... 57/264 X
4,553,708 11/1985 Matsui et al. ..... 242/36
4,660,370 4/1987 Matsui et al. ..... 57/281

FOREIGN PATENT DOCUMENTS 59-163268 9/1984 Japan .

*Primary Examiner*—John Petrakes
*Attorney, Agent, or Firm*—Spensley Horn Jubas & Lubitz

[57] ABSTRACT

A spinning frame control system in which a spinning frame is connected with a winder by means of a bobbin conveyance path and an empty bobbin return path. Identification marks in the form of concentric circles are fixed onto conveyance mediums for conveying spinning bobbins each independently, and readers for the identification mark are disposed in the bobbin feed position from the spinning frame to the conveyance mediums and also in the return path of bobbins discharged from the winder.

9 Claims, 9 Drawing Sheets

SPINNING FRAME CONTROL SYSTEM

FIELD OF THE INVENTION AND RELATED ART STATEMENT

The present invention relates to a spinning frame control system.

Yarn produced by a spinning frame, particularly a ring spinning frame, is conveyed and fed in the form of bobbins after spinning bobbins to an automatic winder in the following step. For conveyance of the spinning bobbins, for example a large number of the spinning bobbins are housed in a bobbin box randomly or in good order and conveyed at a time, or a spinning frame and a winder are connected through a bobbin conveyance path and the bobbins are conveyed independently one by one.

In all the above cases, bobbins once doffed from spinning units of the spinning frame are merely fed as bobbins after spinning to the winder. Consequently, even where a yarn produced from one spinning unit is inferior in quality to a yarn obtained from another unit and it breaks frequently in a rewinding step, it is merely grasped that there are many yarn tied portions in a wound package on the winder side. More particularly, the yarn produced from the above specific spinning unit may be rewound in any winding unit and therefore a bobbin doffed from a spinning unit which produces a yarn of a bad quality for some reason or other and bobbins doffed from other normal spinning units are fed in a random condition to the winder, thus resulting in that the bad quality yarn is incorporated in many of packages doffed on the winder side.

OBJECT AND SUMMARY OF THE INVENTION

It is an object of the present invention to provide a system capable of controlling spinning units of a spinning frame by tracing a conveyance path of yarn produced in each spinning unit, detecting a spinning unit as a producer of a bobbin on which the yarn breaks abnormally frequently during rewinding in a winder, and feeding the yarn breakage information in the winder to the spinning frame.

According to the present invention, identification marks in the form of concentric circles are fixed onto conveyance mediums for conveying spinning bobbins each independently, and readers for the said identification marks are disposed in the bobbin feed position from the spinning frame to the conveyance mediums and also in the return path of bobbins discharged from the winder.

BRIEF DESCRIPTION OF THE DRAWINGS

FIGS. 13 and 14 show a tray identifying example using concentric magnets provided on a tray, of which FIG. 13 is a sectional front view in a read position and FIG. 14 is a plan view of the tray.

DETAILED DESCRIPTION OF PREFERRED EMBODIMENTS

An embodiment of the present invention will be described hereinunder with reference to the drawings.

Figure 3:
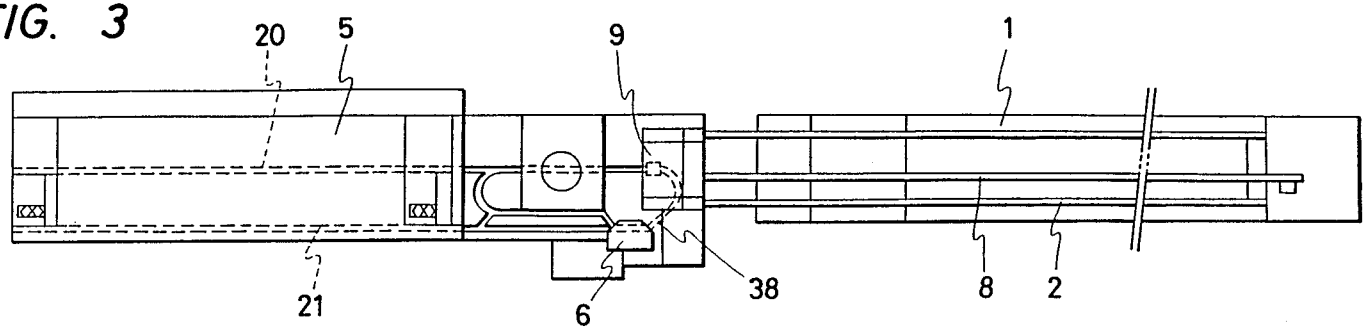
FIG. 3 is a plan view thereof.
Figure 2:
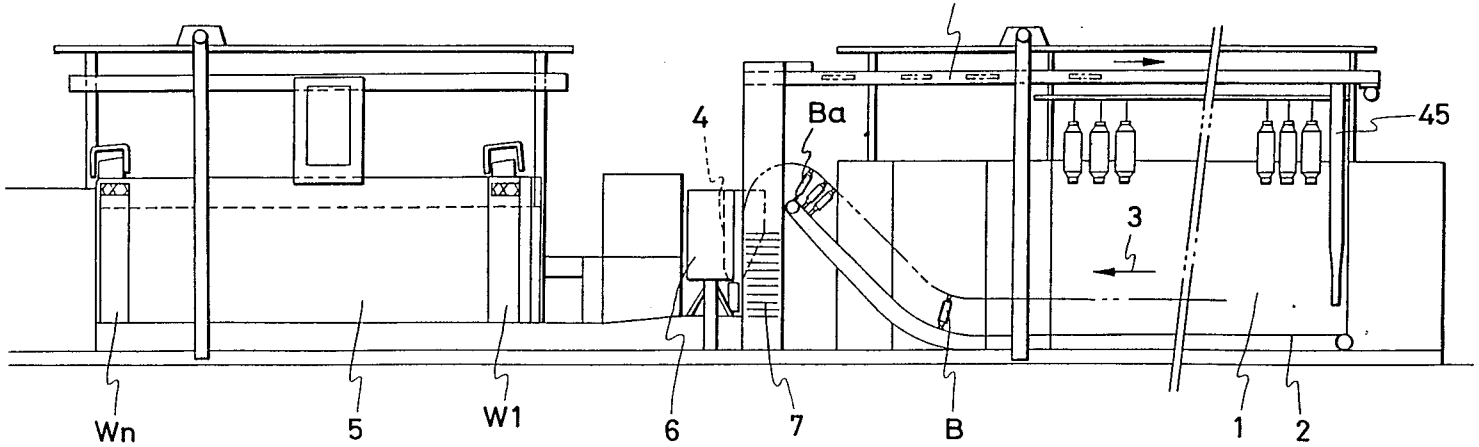
FIG. 2 is a schematic constructional front view showing an example of a spinning winder.

Firstly, a so-called spinning winder in which a spinning frame and a winder are directly coupled together will be explained. For example, in such a spinning winder as disclosed in Japanese Patent Laid Open No. 163268/84, as shown in FIGS. 2 and 3, bobbins B which have become full-loaded in a spinning frame 1 are doffed simultaneously and fitted upright onto pegs which are implanted at pitch intervals of spinning units on a transport band 2 capable of travelling along the spinning units. Thereafter, the transport band 2 moves intermittently in the direction of arrow 3 in accordance with a spinning bobbin request command provided on the winder side, whereby the bobbins are fed and fitted upright onto bobbin trays which are standing by below, through a chute 4 successively from bobbin Ba located at an upper end portion of an inclined conveyor.

On the other hand, on the side of a winder 5, bobbins are fitted upright onto bobbin trays serving as bobbin conveyance mediums which are each separate and independent, and in this state they are fed to winding units. After rewinding therein, the bobbins are discharged. The empty bobbins thus discharged from the winding units are transferred to a bobbin draw-out station 6 integrally with the trays. In the station 6, empty ones and those having a very small amount of residual yarn not to the extent of re-feeding to the winder are drawn out from the respective trays, then the empty bobbins are returned through empty bobbin conveyance paths 7 and 8 to an empty bobbin feed position at one end portion of the spinning frame, while the bobbins with very slight residual yarn are separately discharged or stored into a box. Thus, the trays which have passed the bobbin draw-out station 6 are only empty trays as well as trays which carry thereon bobbins with residual yarn in an amount sufficient for re-feed to the winder. Every time an empty tray reaches a spinning bobbin feed station 9, the transport band 2 on the spinning frame side moves by one pitch and one spinning bobbin is fed and fitted upright onto a stand-by empty tray and is thereby fed again to a winding unit.

Figure 5:
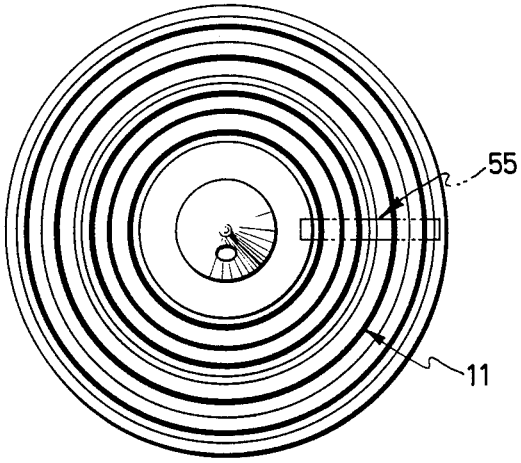
FIG. 5 is a plan view thereof.
Figure 4:
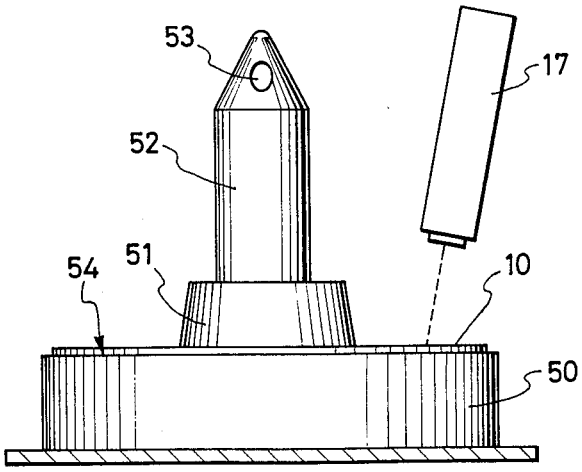
FIG. 4 is a front view showing an example of a bar code affixed to a tray.

An example of a bobbin tray applied to the system of the present invention in such type of a spinning winder, is shown in FIGS. 4 and 5. A tray T comprises a disc-like base 50, a pedestal portion 51 which supports a lower end portion of a bobbin, and a peg 52 for upright fitting thereon of the bobbin, which are formed integrally with one another. The interior of the tray is hollow and an air passing hole 53 is formed in the tray for blowing up a yarn end which is inserted and suspended beforehand in a central bore of the bobbin on the tray, in a rewinding position of the winding unit. On an upper surface 54 of the base 50 of such tray T there is sticked a bar code label 10 describing such concentric bar code as shown in FIG. 5. Bar code labels showing different marks are sticked on all the trays circulating through the winder area.

For example, assuming that in FIG. 3 the spinning frame 1, which comprises 200 spindles on one side, 400 spindles on both sides, of spinning units, and the winder 5, which comprises 10 spindles of winding units WI to Wn, are directly coupled together and the yarn processing ability is well balanced, that each winding unit has a space capable of stocking three bobbins, and that 50 trays are circulated within the region of the winder 5, then it follows that bar codes 11 as coded marks of No. 1 to No. 50 are sticked on the trays respectively.

Figure 6:
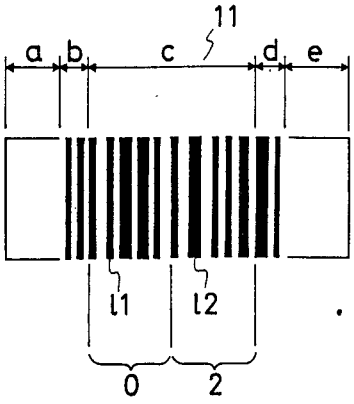
FIG. 6 is a partial plan view showing an example of a bar code.
Figure 7:
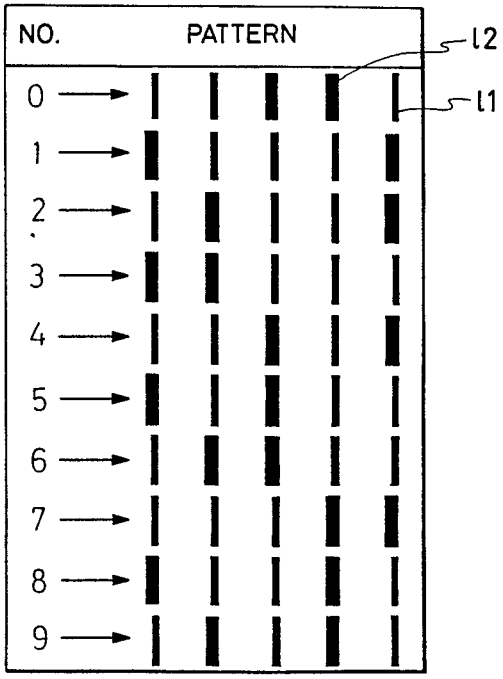
FIG. 7 is an explanatory view showing an example of character pattern of the bar code.

FIGS. 6 and 7 show an example of such bar code 11. The bar code 11 shown in FIG. 6 is described on a radial line surrounded by an alternate long and two short dashes line 55 in FIG. 5. A portion c exclusive of blank portions a and e, start code b and stop code d, is an actual tray code. Numeric characters are expressed by combined patterns of fine black lines l1 and thick l2. In the example of FIG. 6, a tray code 02 is used, and in the above case patterns of 01 to 50 are affixed to the trays respectively.

Figure 8:
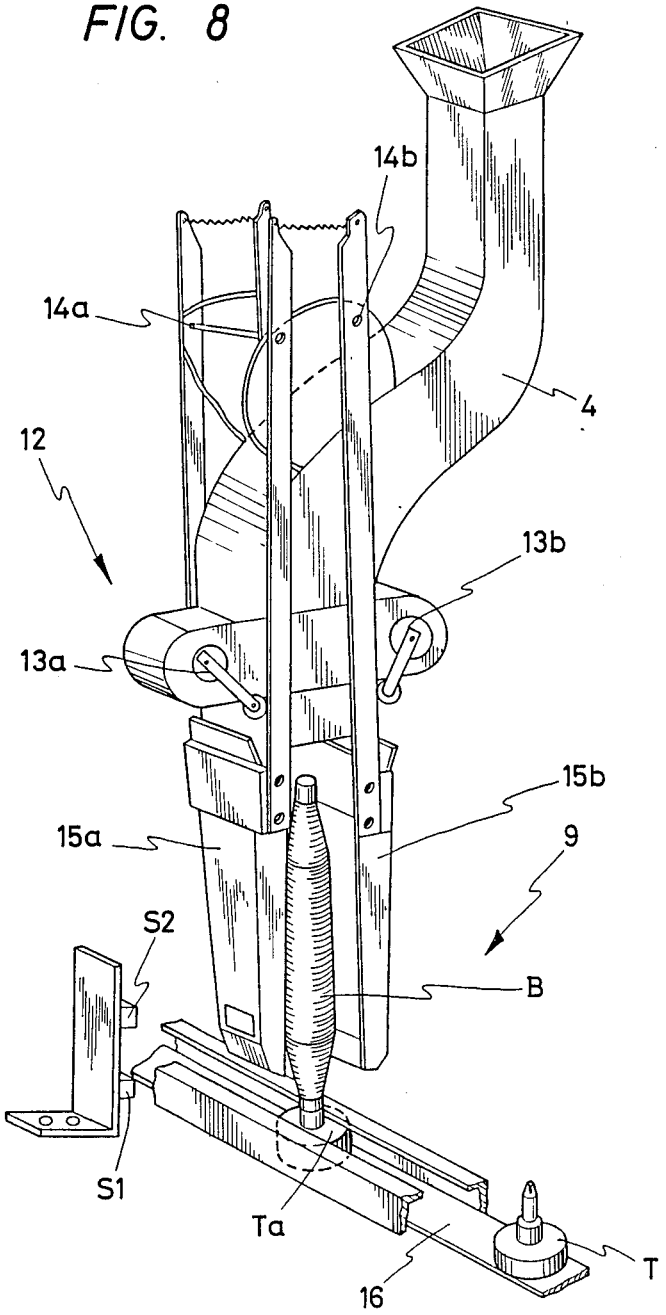
FIG. 8 is a perspective view showing an example of a bobbin feed station.

FIG. 8 shows an example of the spinning bobbin feed station 9 to the empty tray T. When the empty tray T reaches a bobbin feed position Ta and the absence of bobbin on the tray Ta is confirmed by a tray arrival sensor S1 and a bobbin presence/absence sensor S2, a bobbin request signal is output to the spinning frame side, whereupon the transport band shown in FIG. 3 moves by one pitch, so that one bobbin falls into the chute 4 shown in FIG. 8 and is fitted upright onto the tray Ta. In the bobbin feeder 12, movable guide plates 15*a* and 15*b* which are pivoted about shafts 14*a* and 14*b* by rotary solenoids 13*a* and 13*b*, open and close to thereby guide the bobbin and control its movement on a conveyor 16.

Further, in the bobbin draw-out station 6 shown in FIGS. 2 and 3 there is provided a device which uses a vertically movable chucker to draw out the bobbin on the tray arrived at this position and then rises and which sorts empty bobbins and bobbins with very slight residual yarn.

In the bobbin feed station 9 and the bobbin draw-out station 6 there are provided bar code readers 17 and 18 for reading the bar code on each tray, in each in a position opposed to the upper surface 54 of the tray. The tray identification signal read by the bar code reader 17 is once fed and stored into a control unit 19. At this time, data as to by which spinning unit the spinning bobbin fed to the tray T has been produced is also fed and stored in the control unit.

Thus, in this embodiment, a tray and a bobbin thereon are specified at the time of feed of the bobbin onto the tray.

Figure 9:
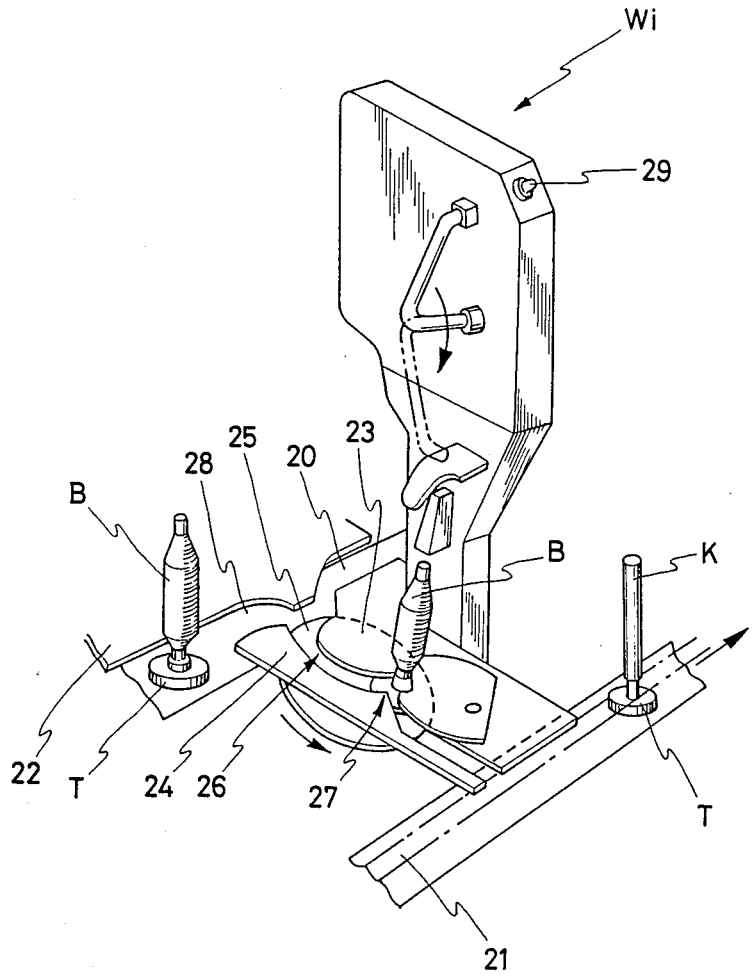
FIG. 9 is a perspective view showing an example of a winding unit.

FIG. 9 shows an example of a winding unit, in which bobbin B is fitted upright on the tray T and in this state there are performed an automatic taking in from a conveyance path, rewinding and discharge. More specifically, the conveyance path 20 for spinning bobbins and a return path 21 for empty bobbins, etc. are disposed along both sides of the winding unit Wi, and the tray is automatically taken into a winding unit having a vacancy for tray in a stand-by slot 26 while its advancing direction is restricted and guided by guide plates 22, 23, 24 and a rotary disc 25, then the tray reaches a rewinding position 27. Once a predetermined number of bobbins are taken into the stand-by slot 26, the entry of the succeeding bobbin is blocked by the tray located on the incoming side of the stand-by slot, and this bobbin goes toward the next unit from a surplus bobbin delivery port 28. The breakage of yarn occurring when the bobbin which has reached the rewinding position is unwound and taken up, is detected by a yarn breakage sensor provided in each unit. The detected signal is fed to the control unit 19 and at the same time the number of times of yarn breakage at the bobbin being taken up in the winding unit is integrated and stored.

In FIG. 9, each winding unit is provided with a lamp 29 which goes on and off in accordance with a signal provided from the control unit when the number of times of yarn breakage during taking up of a single bobbin exceeds a preset value.

The following description is now provided about the operation of the system constructed as above.

Figure 1:
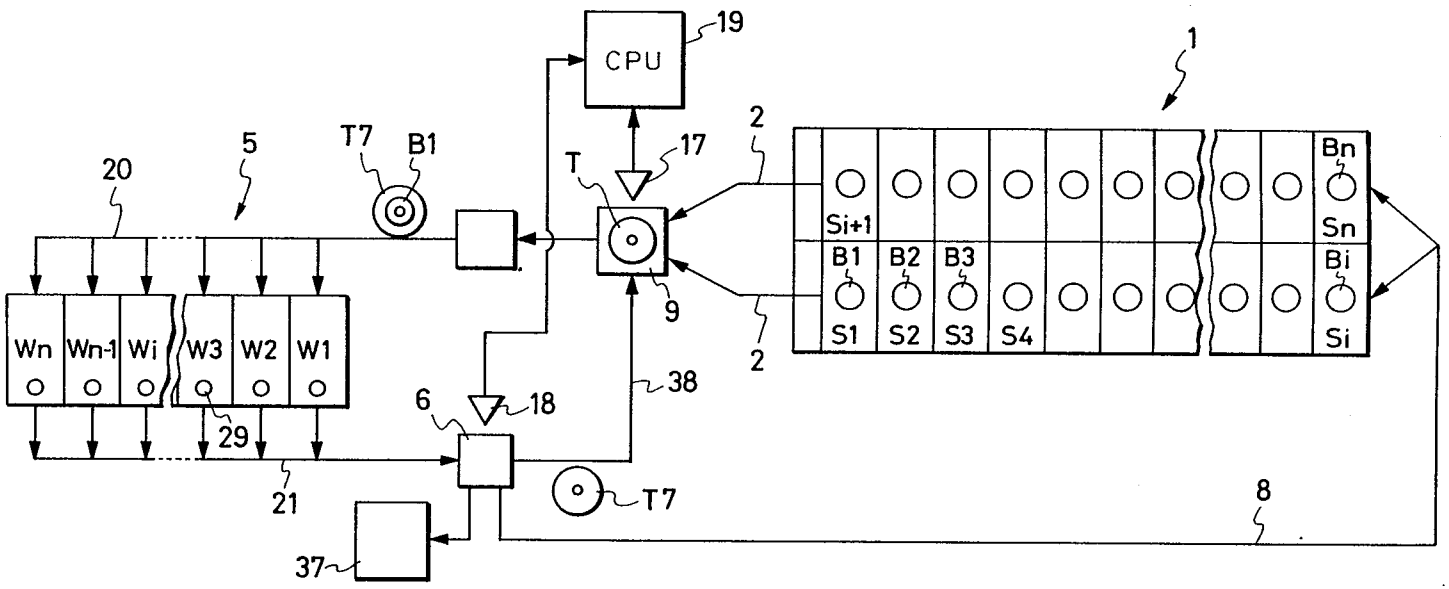
FIG. 1 is a construction element diagram showing an embodiment of a system according to the present invention.

Reference is made to FIG. 1. In the spinning frame 1, marks which specify spinning units are given to all the spinning units; for example, special numbers like S1, S2, S3, ... Si are given successively from one side end portion of the winder and also on the other side there are given special numbers like Si+1, ... Sn.

It is here assumed that a simultaneous doffing is over and solid bobbins B1 to Bi and Bi+1 to Bn have been transferred onto the transport band located in front of the unit.

Under the above condition, upon issuance of a bobbin request signal from the bobbin feed station located on the winder side, first the bobbin B1 positioned at the leftmost end of one-side spinning unit is fed onto a tray T. The conveyance of trays T is random, so it is now assumed that the tray T on which the bobbin B1 has been fitted upright is tray No. T7. At this time, S1, as a code corresponding to T7, is fed and stored into a memory in the control unit 19 by means of a counter. If the next tray is T15, the second fed bobbin B2 is fitted upright thereon, so S2 corresponding to T15 is fed and stored in the above memory.

It is here assumed that the tray T7 has been conveyed, taken into a winding unit W3 of the winder and reached the rewinding position.

When the number of times of yarn breakage occurring during the rewinding operation of the winding unit, the lamp 29 of the unit goes on and off, and when this is confirmed by the operator, the bobbin on the tray T7 discharged from the unit is drawn out by the operator and the tray is conveyed as a bobbin-free tray T7 on the bobbin return path 21 shown in FIG. 1 toward the bobbin draw-out station 6. On the return path 21 are randomly mixed trays on which are upright fitted empty bobbins discharged from other winding units as well as empty trays from other units after drawing out of bobbins by the operator because of excess number of times of yarn breakage.

When various trays which are conveyed in the above condition reach the bobbin draw-out station 6, empty bobbins and bobbins with very slight residual yarn are drawn out in the same station, while empty trays and trays having bobbins with residual yarn pass through the station.

Figure 10:
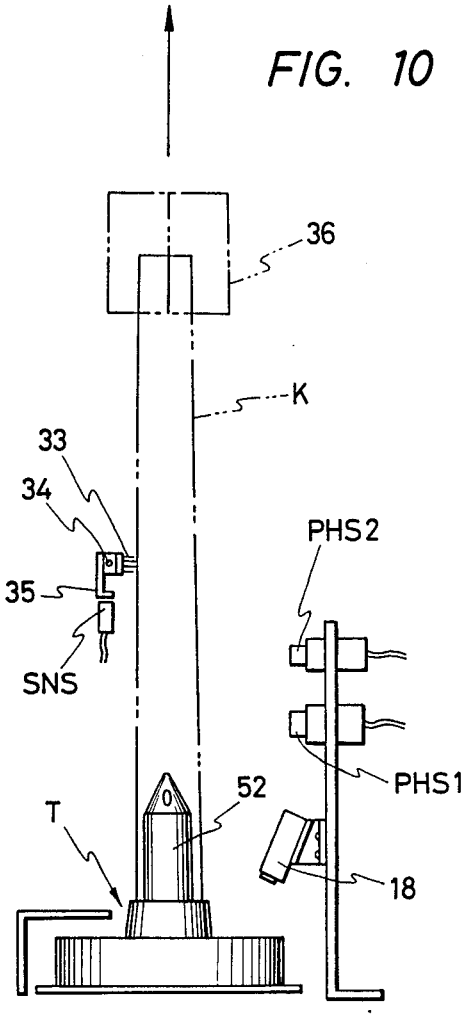
FIG. 10 is a front view showing a positional relation of sensors in a bobbin draw-out station.
Figure 11:
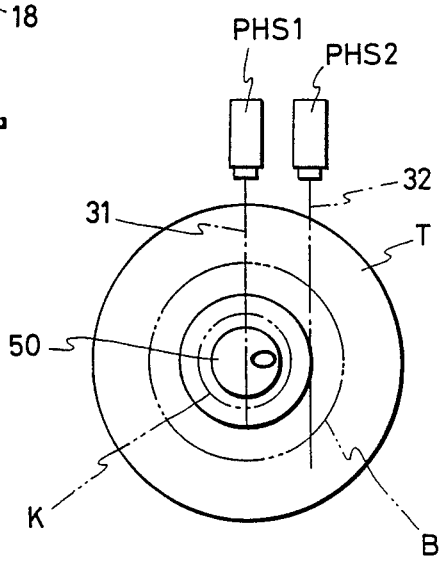
FIG. 11 is a plan view thereof.

More specifically, as shown in FIGS. 10 and 11, in the bobbin draw-out station the code reader 18 for reading the arrival of tray and bar code, a sensor PHS1 for detecting whether a bobbin is present or not on a tray, a sensor PHS2 for detecting a bobbin with residual yarn and a sensor SNS for detecting a bobbin with very slight residual yarn are disposed in predetermined positions. The code reader 18, which is provided in a position opposed to the bar code surface of tray T, detects whether a tray has arrived at the predetermined position or not, by the use of a combined stopper and delivery piece (not shown) for tray, and at the same time reads the bar code 11 and inputs the tray No. T7 to the control unit.

The empty bobbin sensor PHS1 is positioned so that it is located above the tray peg 52 and its optical axis 31 is directed to the tray center. The sensor PHS2 is positioned so that it is above the peg 52 and its optical axis 32 deviates from an outer peripheral surface of an empty bobbin K. Further, the sensor SNS is constituted by a proximity sensor SNS for detecting one end 35 of a brush-like feeler 33 which is in contact with the outer peripheral surface of the empty bobbin and which is pivotable about a shaft 34. If there is a residual yarn when the bobbin K is drawn out upward by the chucker 36, the residual yarn comes into engagement with the feeler 33 to turn and displace the latter thereby detecting a bobbin with very slight residual yarn.

When the tray T7 arrives at the bobbin draw-out station 6 having such various sensors, no bobbin is present on the tray in this position because the bobbin has already been drawn out by the operator. Therefore, a read signal from the code reader 18 and a bobbin absence signal from the sensor PHS1 are fed to the control unit 19 shown in FIG. 1, which in turn judges that the bobbin B1 on the tray T7 which has been read and input beforehand at the bobbin feed station 9 is not present in the draw-out position 6 and that the yarn on the bobbin B1 is a defective yarn. As a result, the spinning unit S1 corresponding to the bobbin B1 is checked.

The empty bobbin which has been drawn out at the draw-out station 6 in FIG. 1 is returned through the conveyance path 8 such as a conveyor so as to be fed onto the peg on the transport band at one end of the spinning frame 1, which is in this embodiment an end portion opposite to the solid bobbin delivery side. Bobbins with very slight residual yarn are distinguished from other bobbins, for example by being put into a bobbin box 37 provided near the draw-out station 6. Consequently, empty trays and trays having bobbins with residual yarn are conveyed mixedly on a passage 38 between the draw-out station 6 and the bobbin feed station 9 in FIG. 3.

Thus, the vacancy of the tray which has arrived at the bobbin draw-out station 6 permits detection of the spinning unit which had produced the bobbin previously located on that tray. When the same spinning unit is detected more than a preset number of times, it is judged that this spinning unit has some defect, and there is made inspection of the unit.

Figure 12:
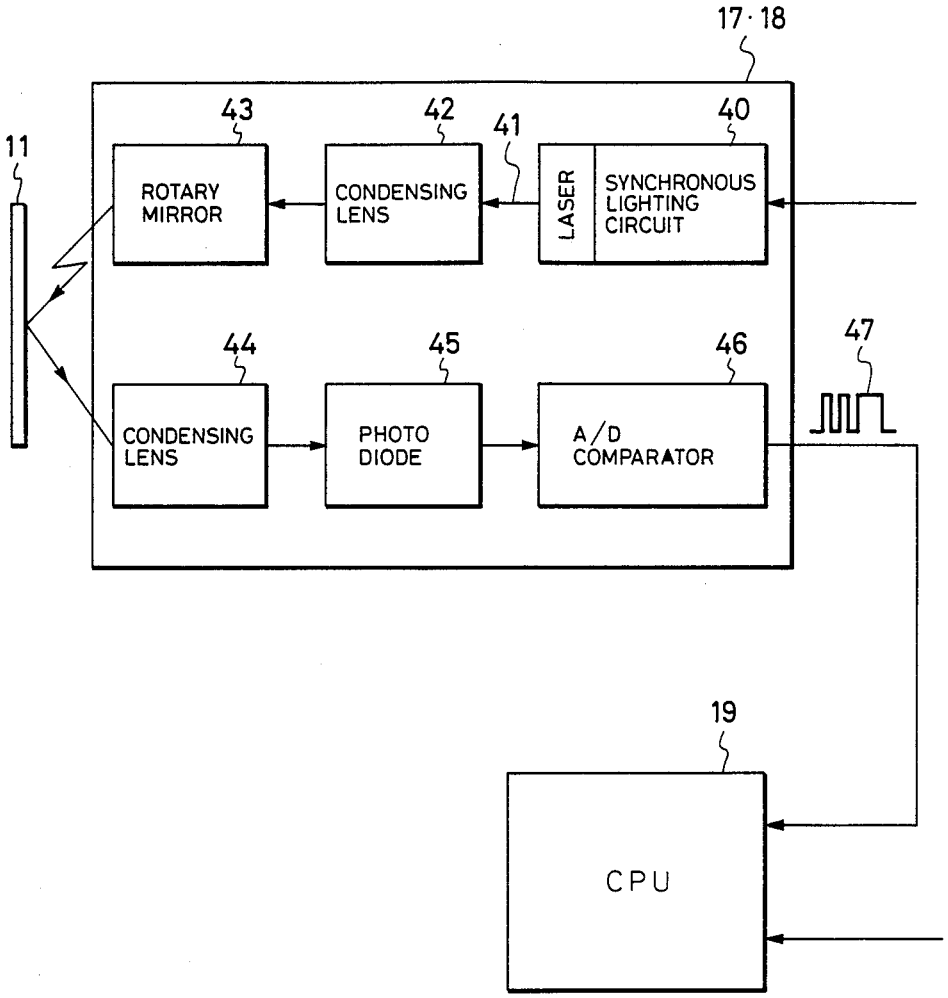
FIG. 12 is a block diagram showing an example of a bar code reader.

In FIG. 12 there is shown an example of the bar code readers 17 and 18. In accordance with a signal indicative of arrival of a tray at the read position a synchronous lighting circuit 40 starts operation, whereby a laser beam 41 is applied to a rotary mirror 43 through a condensing lens 42, and the reflected light beam from the mirror travels in a radial direction of the bar code 11 on the upper surface of the tray to scan and read the bar code. Then, the reflected light beam from the bar code surface is incident on a photo diode 45 through a condensing lens 44 on a light receiving side, and a pulse signal 47 responsive to an incident light quantity is produced by an A/D comparator 46 and fed to an arithmetic section of the control unit 19, whereby the bar code is read.

In FIGS. 13 and 14 there is shown another example of the bar code on the tray. A rubber plate 48 with concentric disc-like magnets M1 to M5 embedded therein is fixed to an upper surface of a base 50 of tray T. Tray is identified by a combination of energization and deenergization of the magnets M1 to M5. Numeral 49 denotes a reader comprising the same number of Hall elements H1 to H5 as the magnets M1 to M5. The reader 49 detects an energized state of each magnet.

Although in the above embodiment the number of times of yarn breakage was set as yarn quality data, a spinning unit may be specified on the basis of various other yarn quality data such as, for example, the number of slubs and the ratio of fine and thick yarn portions.

In the above mentioned first embodiment, it is disclosed that empty bobbins which are discharged from a winder together with trays in on body are separated from the trays at the draw-out station and the separated empty bobbins are returned to a spinning frame. However, the system of the present invention may be applied to such a type of a spinning winder as that a tray and an empty bobbin are transported to a spinning frame in one body, not to be separated. In this second embodiment, a reader for detecting an identification mark of a tray is provided at a draw-out position 6 as similar as in the first embodiment mentioned above. But only a bobbin with very slight residual yarn is drawn out at the draw-out station 6 and an empty bobbin carried on a tray is passed through the draw-out station. An empty bobbin feed station is provided subsequently to the draw-out station and empty bobbins are fed to empty trays from which bobbins with very slight residual yarn have been drawn out and defective bobbins have been drawn out by a worker at a winder. Thus, all of trays carrying empty bobbins thereon are transported to a spinning frame.

In the present invention, as set forth above, a spinning unit which has produced the yarn concerned can be specified by tracing solid bobbins obtained in the spinning frame and on the basis of yarn quality data obtained during rewinding. Consequently, it is possible to effect a machine control for each spinning unit. This is very effective in producing yarn of a good quality.

In the present invention, moreover, since each tray data is read in the form of a concentric bar code on each bobbin conveying medium (tray), it is not necessary to restrict the direction of tray in the tray read position, and tray data can be read at any angle of rotation by the bar code reader.

What is claimed is:

1. A spinning frame control system comprising:

a spinning frame having a plurality of spinning units for producing and doffing spinning bobbins in a sequence, wherein the position of a bobbin in said sequence is dependent on the spinning unit which produced said bobbin;

a winder;

a bobbin conveyance path for conveying doffed spinning bobbins from said spinning frame to said winder;

an empty bobbin return path for conveying empty bobbins from said winder to said spinning frame;

a plurality of conveyance mediums, each of said conveyance mediums being associated with a doffed spinning bobbin located in said sequence;

a corresponding plurality of identification indicia, each of said identification indicia being applied to a respective conveyance medium;

a first reader for reading said identification indicia applied to a conveyance medium before the bobbin associated with said conveyance medium is conveyed to said winder;

a second reader for reading said identification indicia applied to a conveyance medium after the bobbin associated with said conveyance medium has been conveyed to said winder; and identification means for identifying the spinning unit which produced and doffed a bobbin in response to the reading, by said readers, of the identification indicia applied to the conveyance medium associated with said bobbin.

2. A spinning frame control system as claimed in claim 1, further comprising:

a control unit for storing said identification indicia read by the readers.

3. A spinning frame control system as claimed in claim 2, wherein said winder further comprises:

at least one winding unit operable to wind yarn from one of said spinning bobbins;

a yarn breakage sensor for sensing a yarn breakage during the winding operation and for generating a first signal in response to said breakage, said first signal being conveyed to, and stored in, said control unit;

a lamp provided on each of said at least one winding unit;

wherein said control unit produces a second signal for controlling the illumination state of said lamp when said first signal is generates more than a predetermined number of times during the winding operation on said one of said spinning bobbins.

4. A spinning frame control system as claimed in claim 2, wherein each of said conveyance mediums comprises:

a base;

a pedestal for supporting a bobbin; and a peg for fitting the bobbin thereon.

5. A spinning frame control system as claimed in claim 4, wherein each of said identification indicia is in the form of concentric circles applied on the base.

6. A spinning frame control system as claimed in claim 5, wherein each of said identification indicia is a bar code label.

7. A spinning frame control system as claimed in claim 6, further comprising:

a bobbin draw-out station provided adjacent the return path, wherein empty conveyance mediums and bobbins with very slight residual yarn are drawn out, and wherein is disposed:

a code reader for reading the arrival of a conveyance medium and bar code, a first sensor for detecting the presence of a bobbin on a conveyance medium, a second sensor for detecting a bobbin with a first amount of residual yarn, and a third sensor for detecting a bobbin with a second amount of residual yarn, said second amount of residual yarn being a very slight amount of residual yarn.

8. A spinning frame control system as claimed in claim 5, wherein each of said identification indicia is a rubber plate with concentric magnets embedded therein.

9. A spinning frame control system comprising:

a spinning frame having a plurality of spinning units, each of said spinning units being operable to doff a spinning bobbin;

a plurality of conveyance mediums, each of said conveyance mediums being associated with one doffed spinning bobbin;

fixed identification indicia provided on each conveyance medium;

identification means responsive to said fixed identification indicia, for identifying the spinning unit from which each spinning bobbin was doffed;

first detection means for detecting the presence of a doffed spinning bobbin containing defective yarn;

second detection means for detecting the spinning unit from which a spinning bobbin containing defective yarn was doffed;

a control unit;

at least one winding unit operable to wind yarn from one of said bobbins;

a lamp on said at least one winding unit;

said first detection means being a yarn breakage sensor for sensing a yarn breakage during the winding operation and for generating a first signal in response thereto, said first signal being conveyed to, and stored in, said control unit;

wherein said control unit generates a second signal for illuminating said lamp when then number of first signals produced during the yarn winding operation on said bobbin exceeds a predetermined number.

* * * * *